United States Patent [19]

Hosoi

[11] Patent Number: 4,576,890

[45] Date of Patent: Mar. 18, 1986

[54] PREPARATION OF ENCAPSULATED ELECTROSTATOGRAPHIC TONER MATERIAL

[75] Inventor: Noriyuki Hosoi, Fujinomiya, Japan

[73] Assignee: Fuji Photo Film Co., Ltd., Kanagawa, Japan

[21] Appl. No.: 589,535

[22] Filed: Mar. 14, 1984

[30] Foreign Application Priority Data

Mar. 14, 1983 [JP] Japan ..... 58-41960

[51] Int. Cl.[4] ..... G03G 9/08

[52] U.S. Cl. ..... 430/137; 430/110; 430/138

[58] Field of Search ..... 430/110, 137, 138

[56] References Cited

U.S. PATENT DOCUMENTS 3,523,906 8/1970 Vrancken et al. ..... 430/138 X 3,645,911 2/1972 van Basauw et al. ..... 430/138 X 4,439,510 3/1984 McLoughlin ..... 430/138 X

FOREIGN PATENT DOCUMENTS 2809659 9/1979 Fed. Rep. of Germany ..... 430/138

*Primary Examiner*—Roland E. Martin

*Attorney, Agent, or Firm*—Toren, McGeady, Stanger, Goldberg & Kiel

[57] ABSTRACT

A process for the preparation of an encapsulated electrostatographic toner material comprising a stage of forming shells around micro-droplets of core material containing colorant dispersed in an aqueous medium to produce microcapsules therein, and a stage of separating the microcapsules from the aqueous medium, which is characterized in that methylcellulose is employed for stabilizing the micro-droplets of core material in the aqueous medium.

10 Claims, No Drawings

PREPARATION OF ENCAPSULATED ELECTROSTATOGRAPHIC TONER MATERIAL

BACKGROUND OF THE INVENTION

1. Field of the Invention

This invention relates to a process for the preparation of an encapsulated electrostatographic toner material, and more particularly relates to a process for the preparation of a pressure fixable encapsulated electrostatographic toner material.

2. Description of Prior Arts

There is known an electrostatography which comprises developing a tone electrostatic latent image contained on a photoconductive or dielectric surface with a toner material containing a colorant and fixing aid to produce a visible toner image, and transferring and fixing the visible toner image onto a surface of a support medium such as a sheet of paper.

The development of the latent image to produce a visible toner image is carried out by the use of either a developing agent consisting of a combination of a toner material with carrier particles, or a developing agent consisting of a toner material only. The developing process utilizing the combination of a toner material with carrier particles is named "two component developing process", while the developing process utilizing only a toner material is named "one component developing process".

The toner image formed on the latent image is then transferred onto a surface of a support medium and fixed thereto. The process for fixing the toner image to the support medium can be done through one of three fixing processes, that is, a heat fixing process (fusion process), a solvent fixing process and a pressure fixing process.

The pressure fixing process which involves fixing the toner material onto the surface of a support medium under application of pressure thereto is described, for instance, in U.S. Pat. No. 3,269,626. The pressure fixing process involving the use of neither a heating procedure nor a solvent produces no such troubles as inherently attached to either the heat fixing process or the solvent fixing process. Moreover, the pressure fixing process can be employed with a high speed automatic copying and duplicating process, and the access time is very short in the pressure fixing process. Accordingly, the pressure fixing process is thought to be an advantageous fixing process inherently having a variety of preferable features.

However, the pressure fixing process also has a variety of inadvantageous features. For instance, the pressure fixing process generally provides poorer fixability than the heat fixing process does, whereby the toner image fixed onto a paper is apt to rub off easily. Further, the pressure fixing process requires very high pressure for the fixing, and such a high pressure tends to break the cellulose fibers of the support medium such as paper and also produces glossy surface on the support medium. Moreover, the pressing roller requires to have relatively greater size, because the roller necessarily imparts very high pressure to the toner image on the support medium. Accordingly, reduction of the size of a copying and duplicating machine cannot exceed a certain limit defined by the size of a pressing roller.

There has been previously proposed an encapsulated toner material which comprises toner particles enclosed with microcapsules, so as to overcome the above-described disadvantageous features of the pressure fixing process. The encapsulated toner material is prepared by enclosing a core material (containing a colorant such as carbon black) with a shell which is rupturable by the application of pressure in the developing stage. Thus prepared encapsulated toner material has various advantageous features; for instance, fixing of the encapsulated toner material does not require very high pressure, but the fixability is high. Accordingly, the encapsulated toner material is viewed as suitable for the use in the pressure fixing process. However, the encapsulated toner materials proposed up to now appear unsatisfactory in practical use, because they fail to meet some of requirements required for providing smooth copying and duplicating operation and satisfactory toner image fixability and quality.

More in detail, it is required for the toner material for the use as a dry type developing agent in the electrostatography to have excellent powder characteristics (or, powder flowability) to provide high development quality, and to be free from staining the surface of a photosensitive material on which a latent image is formed.

Further, a toner material employed for the two component developing process is also required not to stain the surfaces of the carrier particles employed in combination. The toner material for the use as a developing agent in the pressure fixing process is furthermore required to be satisfactory in the fixability under pressure and not to undergo off-setting on the roller surface, that is, phenomenon that the toner adheres to the roller surface so as to stain it.

In summary, the toner material employed in the pressure fixing process ought to be at a high level in all characteristics such as powder characteristics (powder flowability), fixability onto a support medium (e.g., paper) as well as presevability of the fixed image, resistance to the off-setting, and electron chargeability and/or electroconductivity depending on the system employed. The previously proposed encapsulated toner materials are unsatisfactory in some of these characteristics.

For instance, the encapsulated electrostatographic toner material can be prepared in the form of a powder, as described above, by a process comprising a stage of forming resinous shells around micro-droplets of hydrophobic core material containing colorant dispersed in an aqueous medium to produce microcapsules therein, and a stage of separating the microcapsules from the aqueous medium through a drying procedure such as spray drying.

It has been proposed that in the process for the preparation of an encapsulated toner material, an emulsion stabilizer such as a hydrophilic polymer is introduced into the aqueous medium for stably dispersing the hydrophobic core material in the form of micro-droplets in the aqueous medium. However, the encapsulated toner particles obtained through spray-drying of the microcapsule dispersion produced in the presence of such emulsion stabilizer is liable to aggromerate to form secondary particles. Otherwise, although the encapsulated toner particles are present in a fine powdery form just after the spray-drying, these particles are liable to aggromerate to form secondary particles upon storage under high temperature-high humidity conditions or upon storage at room temperature in an atmospheric condition for a long period. Moreover, these toner particles are apt to aggromerate in a developing apparatus of the copying machine to form not a small amount of secondary particles. The formation of the secondary particles are highly disadvantageous because the secondary particles cause deterioration of resolution of the visible image developed by toner material.

Moreover, the encapsulated toner material prepared in the presence of the known emulsion stabilizer such as a hydrophilic polymer is liable to unfavorably vary its electric resistance and chargeability depending on temperature. The electrostatographic process employing such toner material is easily influenced by fluctuation of surrounding conditions such as temperature and humidity. Accordingly, it can hardly produce a visible toner image of stable quality.

It has also been proposed that a surface active agent is employed in place of the hydrophilic polymer for dispersing the hydrophobic core material in the aqueous medium in the form of micro-droplets. However, the use of a surface active agent is also liable to provide the encapsulated toner particles with increase of the temperature dependence of electric resistance and chargeability. Accordingly, the electrostatographic process employing such toner material is also easily influenced by fluctuation of surrounding conditions such as temperature and humidity. Accordingly, it still hardly produce a visible image of stable quality.

SUMMARY OF THE INVENTION

Accordingly, it is an object of the present invention to provide a process for the preparation of an encapsulated electrostatographic toner material particularly having improved powder characteristics such as improved flowability.

Another object of the present invention is to provide a process for the preparation of an encapsulated electrostatographic toner material showing electric resistance and cheargeability hardly influenced by fluctuation of surrounding conditions such as temperature and humidity, whereby making it possible to stably form a sharp visible image under ordinary surrounding conditions.

There is provided by the present invention a process for the preparation of an encapsulated electrostatographic toner material comprising a stage of forming shells around micro-droplets of core material containing colorant dispersed in an aqueous medium to produce microcapsules therein, and a stage of separating the microcapsules from the aqueous medium, which is characterized in that methylcellulose is employed for stabilizing the micro-droplets of core material in the aqueous medium.

DETAILED DESCRIPTION OF THE INVENTION

There is already known a process for the preparation of microcapsules which comprises forming shells around core materials containing colorant and binder serving as adhesion aid for the colorant against a support medium. The encapsulated toner of the invention can be prepared by known processes.

For instance, an interfacial polymerization method can be mentioned as a process employable for the preparation of the microcapsules of the invention. Examples of other processes employable for the preparation of the microcapsules include an inner polymerization method, a phase separation method, an outer polymerization method, a fusion-dispersion-cooling method, and a coacervation method.

The process for the preparation of microcapsules utilizable in the invention can be carried out by other processes than the above-described processes. These processes can be employed in combination.

As the materials forming the shell of microcapsules, a variety of materials are known. These known materials can be employed in the invention. Examples of the shell-forming material include proteins such as gelatin and casein; plant gum such as gum arabic and sodium alginate; celluloses such as ethylcellulose and carboxymethylcellulose; condensated polymers such as polyamide, polyester, polyurethane, polyurea, polysulfonamide, polysulfanate, polycarbonate, amino resin, alkyd resin and silicone resin; copolymers such as maleic anhydride copolymer, acrylic acid copolymer and methacrylic acid copolymer; vinyl polymers such as polyvinyl chloride, polyethylene and polystyrene; curable resins such as epoly resin; and inorganic polymers. Examples of the polymer preferably employable as the shell material include a polyurethane resin, a polyurea resin and a polyamide resin.

Among these encapsulating methods, the interfacial polymerization method comprising the following process is preferably employed for the preparation of the toner material of the invention.

In the first place, the following two substances are selected:

Substance (A) which as such is a hydrophobic liquid or a substance being soluble, miscible or well dispersable in a hydrophobic liquid; and Substance (B) which as such is a hydrophilic liquid or a substance being soluble, miscible or well dispersable in a hydrophilic liquid, which can react with Substance (A) to produce a polymerization reaction product insoluble in either the hydrophobic liquid or the hydrophilic liquid. Examples of the polymerization reaction product include a polyurethane resin, a polyamide resin, a polyester resin, a polysulfonamine resin, a polyurea resin, an epoxy resin, a polysulfonate resin, and a polycarbonate resin.

In the second place, microdroplets of a hydrophobic liquid including substance (A) and the core material comprising a colorant, a binder, a non-ferromagnetic inorganic pigment (if desired), etc. are dispersed in a hydrophilic liquid such as water containing Substance (B) and methylcellulose (emulsion stabilizer).

The substance (A) is caused to react with Substance (B) to undergo an interfacial polymerization reaction in the dispersion by an appropriate procedure, for instance, by heating the dispersion. Thus, the shell of a polymerization reaction product of Substance (A) with Substance (B) (and/or water) is formed around the hydrophobic droplets to produce microcapsules comprising the core material and the shell enclosing the core material.

Examples of Substance (A) preferably employed for the preparation of the shell in the invention include compounds having isocyanete groups described below:

(1) Diisocyanete m-phenylene diisocyanate, p-phenylene diisocyanate, 2,6-tolylene diisocyanate, 2,4-tolylene diisocyanate, naphthalene 1,4-diisocyanate, diphenylmethane 4,4'-diisocyanate, 3,3'-dimethoxy-4,4'-biphenyl diisocyanate, 3,3'-dimethyldiphenylmethane 4,4'-diisocyanate, xylylene 1,4-diisocyanate, xylylene 1,3-diisocyanate, 4,4'-diphenylpropane diisocyanate, trimethylene diisocyanate, hexamethylene diisocyanate, propylene 1,2-diisocyanate, butylene 1,2-diisocyanate, ethylidyne diisocyanate, cyclohexylene 1,2-diisocyanate, cyclohexylene 1,4-diisocyanate, p-phenylene diisocyanate, triphenylmethane diisocyanate;

(2) Triisocyanate 4,4',4''-triphenylmethane triisocyanate, polymethylenepolyphenyl triisocyanate, toluene-2,4,6-triisocyanate;

(3) Tetraisocyanate 4,4'-dimethyldiphenylmethane 2,2',5,5'-tetraisocyanate; and (4) Polyisocyanate prepolymer an addition product of hexamethylene diisocyanate and hexanetriol, an addition product of 2,4-tolylene diisocyanate and catechol, an addition product of 2,4-tolylene diisocyanate and hexanetriol, an addition product of 2,4-tolylene diisocyanate and trimethylolpropane, an addition product of xylylene diisocyanate and trimethylolpropane.

Examples of Substance (B) preferably employed for the preparation of the shell in the invention include compounds described below:

(1) Water;

(2) Polyol ethylene glycol, propylene glycol, 1,4-butanediol, 1,5-pentanediol, 1,6-heptanediol, 1,7-heptanediol, 1,8-octanediol, trimethylolpropane, hexanetriol, catechol, resorcinol, hydroquinone, 1,2-dihydroxy-4-methylbenzene, 1,3-dihydroxy-5-methylbenzene, 3,4-dihydroxy-1-methylbenzene, 3,5-dihydroxy-1-methylbenzene, 2,4-dihydroxy-1-ethylbenzene, 1,3-naphthalenediol, 1,5-naphthalenediol, 2,3-naphthalenediol, 2,7-naphthalenediol, o,o'-biphenol, p,p'-biphenol, 1,1'-bi-2-naphthol, Bisphenol A, 2,2'-bis(4-hydroxyphenyl)butane, 2,2'-bis(4-hydroxyphenyl)isopentane, 1,1'-bis(4-hydroxyphenyl)cyclopentane, 1,1'-bis(4-hydroxyphenyl)cyclohexane,-2,2,2'-bis(4-hydroxy-3-methylphenyl)propane, bis(2-hydroxyphenyl)-methane, xylylenediol, pentaerythritol, glycerol, sorbitol;

(3) Polyamine ethylenediamine, tetramethylenediamine, pentamethylenediamine, hexamethylenediamine, p-phenylenediamine, m-phenylenediamine, 2-hydroxytrimethylenediamine, diethylenetriamine, triethylenetetraamine, diethylaminopropylamine, tetraethylenepentaamine, an addition product of an epoxy compound and an amine compound; and (4) Piperazine piperazine, 2-methylpiperazine, 2,5-dimethylpiperazine.

By the use of these Substance (A) and Substance (B) a polyurethane resin or a polyurea resin is prepared.

In the present invention, the terms "polyurethane" and "polyurea" means to include polymers produced by polycondensation reaction between polyisocyanate and one or more of the counterpart compounds such as polyol, water, polyamine and piperazine. Accordingly, the term "polyurethane" means either a simple polyurethane comprising substantially urethane bondings only or a polymer comprising urethane bondings and a relatively small number of urea bondings. The term "polyurea" means either a simple polyurea comprising substantially urea bondings only or a polymer comprising urea bondings and a relatively small number of urethane bondings.

In the above-described combinations, Substance (A) can be replaced with an acid chloride, a sulfonyl chloride, or a bischloroformate to produce a shell of other resinous material such as a polyamide resin.

Examples of these compounds are as follows:

(1) Acid chloride oxazoyl chloride, succinoyl chloride, adipoyl chloride, sebacoyl chloride, phthaloyl chloride, isophthaloyl chloride, terephthaloyl chloride, fumaroyl chloride, 1,4-cyclohexanedicarbonyl chloride, polyesters containing acid chloride groups, polyamides containing acid chloride groups;

(2) Sulfonyl chloride 1,3-benzenesulfonyl chloride, 1,4-benzenedisulfonyl chloride, 1,5-naphthalenedisulfonyl chloride, 2,7-naphthalenedisulfonyl chloride, 4,4'-biphenyldisulfonyl chloride, p,p'-oxybis(benzenesulfonyl chloride), 1,6-hexanedisulfonyl chloride;

(3) Bischloroformate ethylene bis(chloroformate), tetramethylene bis(chloroformate), hexamethylene bis(chloroformate), 2,2'-dimethyl-1,3-propane bis(chloroformate), p-phenylene bis(chloroformate).

In the preparation of the dispersion of hydrophobic micro-droplets containing Substance (A) and the core material, the hydrophobic liquid to be dispersed preferably contains a low-boiling solvent or a polar solvent. These solvents serve for accelerating formation of the shell which is a reaction product between Substance (A) and Substance (B). Examples of these solvents include methyl alcohol, ethyl alcohol, diethyl ether, tetrahydofuran, dioxane, methyl acetate, ethyl acetate, acetone, methyl ethyl ketone, methyl isobutyl ketone, cyclohexanone, n-pentane, n-hexane, benzene, petroleum ether, chloroform, carbon tetrachloride, methylene chloride, ethylene chloride, carbon disulfide and dimethylformamide.

There is no limitation on the shell material, so far as the material is rupturable under pressure in the developing stage. Accordingly, materials other than those described hereinbefore can be likewise employed. Examples of these materials include homopolymers and copolymers of styrene or a substituted styrene such as polystyrene, poly(p-chlorostyrene), styrene-butadiene copolymer, styrene-acrylic acid copolymer, styrene-acrylic ester copolymer, styrene-methacrylic acid copolymer, styrene-methacrylic ester copolymer, styrene-maleic anhydride copolymer, and styrene-vinyl acetate copolymer; polyvinyltoluene resin, acrylic ester homopolymer, methacrylic ester homopolymer, xylene resin, methylvinyl ether-maleic anhydride resin, vinyl butyral resin, poly(vinyl alcohol) resin, and poly(vinylpyrrolidone).

The shell can be composed substantially of a complex layer. For instance, the shell can comprise two or more polymers selected from the group consisting of a polyurethane resin, a polyurea resin and a polyamide resin.

The encapsulated toner material whose shell is composed substantially of a complex layer comprising two or more polymers selected from the group consisting of a polyurethane resin, a polyurea resin and a polyamide resin can be produced as follows.

In a hydrophobic liquid comprising the aforementioned core material are dissolved an acid chloride and a polyisocyanate. This solution is then dispersed in an aqueous medium comprising a polyamine or piperazine and a dispersing agent to produce micro-droplets of the core material having an average diameter in the range from about 0.5 to about 1,000 microns in the aqueous medium.

The dispersion produced above is then neutralized or made weak alkaline by addition of an alkaline substance, and subsequently heated to a temperature between 40° and 90° C. Upon completion of these procedures, a complex layer consisting substantially of a polyamide resin and a polyurea resin in which the polyamide resin is a reaction product produced by reaction between the acid chloride and the polyamine, and the polyurea resin is a reaction product produced by reaction between the polyisocyanate and the polyamine, is formed around the droplet of the core material. Thus, the encapsulated particle having the complex layer shell is obtained.

If a polyol is further added to the hydrophobic liquid in the above-described procedure, there is produced around the the droplet of the hydrophobic core material a complex layer shell consisting substantially of the polyamide resin and a polyurethane resin, in which the polyurethane resin is a reaction product of the polyisocyanate with the polyol.

In the latter procedure, a complex layer consisting substantially of the polyamide, polyurea and polyurethane resins can be produced, if the polyamine is introduced into the reaction system in an amount exceeding the amount required to react with the introduced acid chloride.

The shell of thus produced particle is, as described above, a complex layer shell. The term "complex layer shell" means to include a shell comprising a polymer mixture, as well as to include a double layer shell. The term "double layer shell" is not intended to mean only a shell in which the two layers are completely separated by a simple interface, but include a shell in which the interface is not clearly present in the shell, but the ratio between one polymer and another polymer (or other polymers) varies from the inner phase to the outer phase of the shell.

The acid chloride can be replaced with a dicarboxylic acid or its acid anhydride. Examples of the dicarboxylic acid include adipic acid, sebacic acid, phthalic acid, terephthalic acid, fumaric acid, 1,4-cyclohexanedicarboxylic acid, and 4,4'-biphenyldicarboxylic acid. Examples of the acid anhydride include phthalic anhydride.

The aforementioned outer polymerization method is also employed preferably in the present invention.

The outer polymerization method can be carried out by: dispersing the core material in an aqueous medium containing methylcellulose in the form of micro-droplets; dissolving or dispersing a reactive monomer, prepolymer, oligomer, etc, in the aqueous medium; and causing polymerization reaction therein by adjustement of pH, heating, and/or addition of catalyst to form.

In the present invention, the outer polymerization method can be carried out utilizing the following processes:

a process comprising reaction between an organic amine, an acidamide, and a water-soluble epoxy compound (Japanese Patent Publication No. 38(1963)-24420);

a process utilizing polycondensation reaction between urea and formalin, melamine and formaline, or phenol and formalin (Japanese Patent Publications No. 38(1963)-12380, No. 38(1963)-12518, and No. 46(1971)-30282, and Japanese Patent Provisional Publications No. 47(1972)-42380 and No. 52(1977)-66878, etc.);

a process utilizing urea and formalin in combination with polyacrylic acid or an ethylene-maleic anhydride copolymer (Japanese Patent Provisional Publications Nos. 51(1976)-9079 and No. 51(1976)-14438, etc.);

and a process comprising reaction between spiroacetal heterocyclic amine and aldehyde (Japanese Patent Provisional Publications No. 49(1974)-99969 and No. 50(1975)-8780, etc.).

The outer polymerization method and the surface polymerization method can be combined to give satisfactory result.

The core material contains a colorant for producing a visible image from the latent image. The colorant generally is a dye or a pigment, but a certain agent providing no directly visible image such as fluorescent substance can be employed as the colorant, if desired.

The colorant is generally selected from a variety of dyes, pigments and the like employed generally in the conventional electrostatographic copying and duplicating process. Generally the colorant is a black toner or a chromatic toner. Examples of the black toners include carbon black. Examples of the chromatic toners include blue colorants such as copper phthalocyanine and a sulfonamide derivative dye; yellow colorants such as a benzidine derivative dye, that is generally called Diazo Yellow; and and red colorants such as Rhodamine B Lake, that is, a double salt of xanthine dye with phosphorus wolframate and molybdate, Carmine 6B belonging to Azo pigment, and a quinacridone derivative.

The core material contains a binder (adhesive material) for keeping the colorant within the core and assisting the fixing of the colorant onto the surface of a support medium such as a paper.

Examples of the binder include a solvent having a boiling point such as a boiling point higher than 180° C. and a polymer.

Examples of the high-boiling solvent serving as the binder include the following liquids:

(1) Phthalic acid esters dibutyl phthalate, dihexyl phthalate, diheptyl phthalate, dioctyl phthalate, dinonyl phthalate, dodecyl phthalate, butyl phthalyl butyl glycolate, dibutyl monofluorophthalate;

(2) Phosphoric acid esters tricresyl phosphate, trixylenyl phosphate, tris(isopropylphenyl)phosphate, tributyl phosphate, trihexyl phosphate, trioctyl phosphate, trinonyl phosphate, tridecyl phosphate, trioleyl phosphate, tris(butoxyethyl)phosphate, tris(chloroethyl)phosphate, tris(dichloropropyl)phosphate;

(3) Citric acid esters

O-acetyl triethyl citrate, O-acetyl tributyl citrate, O-acetyl trihexyl citrate, O-acetyl trioctyl citrate, O-acetyl trinonyl citrate, O-acetyl tridecyl citrate, triethyl citrate, tributyl citrate, trihexyl citrate, trioctyl citrate, trinonyl citrate, tridecyl citrate;

(4) Benzoic acid esters butyl benzoate, hexyl benzoate, heptyl benzoate, octyl benzoate, nonyl benzoate, decyl benzoate, dodecyl benzoate, tridecyl benzoate, tetradecyl benzoate, hexadecyl benzoate, octadecyl benzoate, oleyl benzoate, pentyl o-methylbenzoate, decyl p-methylbenzoate, octyl o-chlorobenzoate, lauryl p-chlorobenzoate, propyl 2,4-dichlorobenzoate, octyl 2,4-dichlorobenzoate, stearyl 2,4-dichlorobenzoate, oleyl 2,4-dichlorobenzoate, octyl p-methoxybenzoate;

(5) Aliphatic acid esters hexadecyl myristate, dibutoxyethyl succinate, dioctyl adipate, dioctyl azelate, decamethylene-1,10-diol diacetate, triacetin, tributin, benzyl caprate, pentaerythritol tetracaproate, isosorbitol dicaprilate;

(6) Alkylnaphthalenes methylnaphthalene, dimethylnaphthalene, trimethylnaphthalene, tetramethylnaphtharene, ethylnaphthralene, diethylnaphthalene, triethylnaphthalene, monoisopropylnaphthalene, diisopropylnaphthalene, tetraisopropylnaphthalene, monomethylethylnaphthalene, isooctylnaphthalene;

(7) Dialkylphenyl ethers di-o-methylphenyl ether, di-m-methyldiphenyl ether, di-p-methylphenyl ether;

(8) Amides of fatty acids and aromatic sulfonic acids

N,N-dimethyllauroamide, N,N-diethylcaprylamide, N-butylbenzenesulfonamide;

(9) Trimellitic acid esters trioctyl trimellitate;

(10) Diarylalkanes diarylmethanes such as dimethylphenylphenylmethane, diarylethanes such as 1-methylphenyl-1-phenylethane, 1-dimethylphenyl-1-phenylethane and 1-ethylphenyl-1-phenylethane.

For the purpose of the present invention, the high-boiling solvent is preferably selected from phthalic acid esters, phosphoric acid esters, diarylalkanes and alkylnaphthalenes.

Examples of the polymer serving as the binder include the following polymers:

polyolefin, olefin copolymer, polystyrene, styrene-butadiene copolymer, epoxy resin, polyester, natural and synthetic rubbers, poly(vinylpyrrolidone), polyamide, cumarone-indene copolymer, methyl vinyl ether-maleic anhydride copolymer, maleic acid-modified phenol resin, phenol-modified terpene resin, silicone resin, epoxy-modified phenol resin, amino resin, polyurethane elastomer, polyurea elastomer, homopolymer and copolymer of acrylic acid ester, homopolymer and copolymer of methacrylic acid ester, acrylic acid-long chain alkyl methacrylate copolymer oligomer, poly(vinyl acetate), and poly(vinyl chloride).

In the present invention, the polymer of the binder is preferably selected from the group consisting of homopolymers and copolymers of acrylic acid esters (acrylates), homopolymers and copolymers of methacrylic acid esters (methacrylates), and styrene-butadiene copolymers.

In the invention, each of the polymer and the high-boiling solvent can be employed alone or in combination. However, the polymer and the high-boiling solvent are preferably employed in combination to form, for instance, a pasty binder.

There is no limitation on the ratio between the high-boiling solvent and the polymer, but the ratio is preferably chosen within the range of 0.1–40 (high-boiling solvent/polymer), ratio by weight.

As described hereinbefore, the core material of the encapsulated toner of the invention comprises a colorant and a binder. Other additives such as a fluorine-containing resin which is effective in prevention of the off-setting can be also included. The resinous shell of the encapsulated toner can be provided with a charge control agent such as a metal-containing dye or nigrosine, a flow improving agent such as hydrophobic silica, or other additive. These additive can be introduced into the shell of the encapsulated toner in an optional stage such as in the course of formation of the shell or after separating and drying the encapsulated toner.

The core material may contain a white pigment such as calcium carbonate or titanium dioxide as a color adjusting agent, if desired.

In the present invention, the materials and substances for the preparation of the encapsulated toner can be employed in combination.

The methylcellulose employed in the process of the present invention functions as an emulsion stabilizer for stably dispersing the hydrophobic core material in an aqueous medium in the form of micro-droplets prior to formation of the microcapsules therein.

The methylcellulose employed in the invention as the emulsion stabilizer preferably has an average molecular weight in the range of 10,000 to 50,000. The methoxy substitution degree of the methylcellulose preferably is in the range of 1.2 to 2.0. Further, a portion of methoxy groups attached to the methylcellulose are preferably substituted with hydroxypropoxy groups, in which the substitution degree preferably ranges from 20 to 60%.

The methylcellulose having functioned as the emulsion stabilizer in the process of the invention is preferably treated at the hydroxyl groups of the cellulose skeleton with a hydrophobic treating agent (an agent for providing hydrophobic property) such as a urea-formalin resin, methylolmelamine, glyoxal, tannic acid or citric acid so that the hydroxyl groups undergo dehydration condensation to become hydrophobic. Preferred hydrophobic agent is methylolmelamine. The above-mentioned hydrophobic treatement can be done, for instance, by introducing after completion of the encapsulating reaction the hydrophobic treating agent into the reaction liquid containing methylcellulose and microcapsules.

According to the present invention, the methylcellulose serving as the emulsion stabilizer is introduced in the reaction liquid before the encapsulating reaction is carried out. The methylcellulose is preferably introduced in an amount of not more than 10% by weight, more preferably not more than 5% by weight, based on the total amount of the shell materials and core materials (e.g., binder, colorant such as dye, magnetizable substance).

In the present invention, a procedure for dispersing or emulsifying the hydrophobic core material in the form of microdroplets in the aqueous medium containing the methylcellulose can be carried out by means of a known homogenizer such as one belonging to the stirring type, the high pressure injecting type, the ultrasonic vibrating type and the kneader type. Particularly preferred homogenizers are a colloid mill, a conventional homogenizer, and an electromagnetic distortion inducing ultrasonic homogenizer.

The encapsulation reaction is then carried out, for instance, by heating the emulsified reaction liquid in the presence of an appropriate catalyst, as described hereinbefore, so as to form shells around the microdroplets of the core material. Subsequently, the resulting microcapsules are is generally separated from the aqueous reaction medium by spray drying to obtain a dry encapsulated toner. The separation of the microcapsules from the aqueous medium can be done by freeze-drying. Otherwise, the aqueous medium containing the microcapsules can be centrifuged to remove the liquid phase, and the resulting microcapsules (possibly in the form of slurry) can be heated in an oven to give a powdery encapsulated toner. The encapsulated toner is preferably washed with water after the separation from the aqueous reaction medium through centrifugal procedure and prior to the drying procedure, whereby removing methylcellulose attached to the surface of the microcapsules.

The dried encapsulated toner particles are preferably heated to further improve their powder characteristics. The temperature for heating the dried encapsulated toner particles preferably ranges from 50° to 300° C., and more preferably ranges from 80° to 150° C. The period required for performing the heating varies with the heating temperature, the nature of the binder, etc. Generally, the period ranges from 10 minutes to 48 hours, and preferably ranges from 2 to 24 hours.

There is no limitation on the means employed for carrying out the heating procedure. Examples of the heating means include an electric furnace, a muffle furnace, a hot plate, an electric drying oven, a fluid bed drying apparatus, and a infrared drying apparatus.

The present invention will be illustrated by the following examples which are by no means intended to introduce any restriction into the invention.

EXAMPLE 1

A dispersion of 3 g. of carbon black and 15 g. of magnetite (tradename EPT-1000, available Toda Industry Co., Ltd., Japan) in 27 g. of diisopropylnaphthalene prepared in a mortar was mixed with 10 g. of a mixture of acetone and methylene chloride (1:3) to prepare a primary liquid. Separately, 4 g. of an adduct of hexamethylene diisocyanate and hexanetriol (3:1 molar ratio addition product) was added to the primary liquid to prepare a secondary liquid. The mixing procedure was carried out at a temperature of not higher than 25° C.

To an aqueous solution of 2 g. of methylcellulose (methoxy substitution ratio 1.8, average molecular weight 15,000) in 60 ml. of water kept at 20° C. was portionwise added under vigorous stirring the secondary liquid to produce an oil-in-water emulsion containing oily droplets having diameter of 5–15 μm. The formation of the emulsion was carried out at a temperature of not higher than 20° C. by chilling the outer surface of the reaction vessel. The stirring was further continued after the production of emulsion. To the emulsion was added 100 ml. of water (kept at 40° C.). The resulting mixture was then slowly heated up to 90° C. over 30 min. and kept for 20 min. at the temperature to perform the encapsulating reaction.

Thus obtained aqueous microcapsule dispersion was subjected to centrifugal separation (5000 rpm) to separate the microcapsules from water. The separated microcapsules were then dispersed in water to prepare 30 wt.% dispersion. This dispersion was again subjected to centrifugal separation and the separated microcapsules were again dispersed in water in the same manner as above. The microcapsule slurry thus washed with water was heated in oven to obtain a powdery encapsulated toner.

The powder characteristics and volume resistance of the above encapsulated toner were evaluated under two temperature-humidity conditions, namely, (I) 14° C., 40%RH, and (II) 30° C., 90%RH.

Under the condition (I), the encapsulated toner particles are present independently from each other, and very flowable. The volume resistance was $10^{15}$ ohm-cm.

Under the condition (II), the encapsulated toner particles are still present independently from each other, and very flowable. The volume resistance was $10^{14}$ ohm-cm.

According to the conventional electrostatographic copying and duplicating process, a latent image was developed through magnetic brush system using the above encapsulated toner as the magnetizable toner for one-component developing system at 14° C., 40%RH, and 30° C., 90%RH. Satisfactory visible image was obtained under both conditions.

The paper carrying the visible image was treated under a pressing roller at a pressure of 350 kg./cm.$^2$. There was obtained a toner image with high sharpness and well fixed onto the paper. Further, off-setting of the toner was at a very low level.

EXAMPLE 2

A dispersion of 15 g. of magnetite (tradename EPT-1000, available Toda Industry Co., Ltd.) in 27 g. of 1-isopropylphenyl-2-phenylmethane prepared in a sand mill was mixed with 10 g. of ethyl acetate to prepare a primary liquid. Separately, 4 g. of an adduct of hexamethylene diisocyanate and hexanetriol (3:1 molar ratio addition product) and 1 g. of terephthalic chloride were added to the primary liquid to prepare a secondary liquid. The mixing procedure was carried out at a temperature of not higher than 25° C.

To an aqueous solution of 2 g. of methylcellulose (methoxy substitution ratio 1.75, average molecular weight 25,000, substitution ratio of hydropropoxy groups against methoxy groups 18%) in 60 ml. of water kept at 20° C. was portionwise added under vigorous stirring the secondary liquid to produce an oil-in-water emulsion containing oily droplets having diameter of 5–15 μm. The formation of the emulsion was carried out at a temperature of not higher than 20° C. by chilling the outer surface of the reaction vessel. The stirring was further continued after the production of emulsion. To the emulsion was added 100 ml. of an aqueous diethylenetriamine solution (5 wt.% concentration, kept at 20° C.), and the resulting mixture was adjusted to pH 10.0 by addition of sodium carbonate. The resulting mixture was then slowly heated up to 90° C. over 30 min. and kept for 20 min. at the temperature to perform the encapsulating reaction.

Thus obtained aqueous microcapsule dispersion was subjected to centrifugal separation (5000 rpm) to separate the microcapsules from water. The separated microcapsules were then dispersed in water to prepare 30 wt.% dispersion. This disrpesion was again subjected to centrifugal separation and the separated microcapsules were again dispersed in water in the same manner as above. The washing procedure was repeated once more time. The microcapsule slurry thus washed with water was dried in an oven to obtain a powdery encapsulated toner.

The powder characteristics and volume resistance of the above encapsulated toner were evaluated under two temperature-humidity conditions, namely, (I) 14° C., 40%RH, and (II) 30° C., 90%RH.

Under the condition (I), the encapsulated toner particles are present independently from each other, and very flowable. The volume resistance was $10^{15}$ ohm-cm.

Under the condition (II), the encapsulated toner particles are still present independently from each other, and very flowable. The volume resistance was $10^{15}$ ohm-cm.

According to the conventional electrostatographic copying and duplicating process, a latent image was developed through magnetic brush system using the above encapsulated toner as the magnetizable toner for one-component developing system at 14° C., 40%RH, and 30° C., 90%RH. Satisfactory visible image was obtained under both conditions.

The paper carrying the visible image was treated under a pressing roller at a pressure of 350 kg./cm$^2$. There was obtained a toner image with high sharpness and well fixed onto the paper. Further, off-setting of the toner was at a very low level.

EXAMPLE 3

A microcapsule dispersion was prepared in the same manner as in Example 2.

To the microcapsule dispersion was added 0.5 g. of methylolmelamine (Sumitex Resin M-3, available from Sumitomo Chemical Co., Ltd., Japan). The resulting mixture was adjusted to pH 4.5 by addition of acetic acid, and heated under stirring at 60° C.

Thus obtained aqueous microcapsule dispersion was subjected to centrifugal separation (5000 rpm) to separate the microcapsules from water. The separated microcapsules were then dispersed in water to prepare 30 wt.% dispersion. This dispersion was again subjected to centrifugal separation and the separated microcapsules were again dispersed in water in the same manner as above. The washing procedure was repeated once more time. The microcapsule slurry thus washed with water was dried in an oven to obtain a powdery encapsulated toner.

The powder characteristics and volume resistance of the above encapsulated toner were evaluated under two temperature-humidity conditions, namely, (I) 14° C., 40%RH, and (II) 30° C., 90%RH.

Under the condition (I), the encapsulated toner particles are present independently from each other, and very flowable. The volume resistance was $10^{16}$ ohm-cm.

Under the condition (II), the encapsulated toner particles are still present independently from each other, and very flowable. The volume resistance was $10^{16}$ ohm-cm.

According to the conventional electrostatographic copying and duplicating process, a latent image was developed through magnetic brush system using the above encapsulated toner as the magnetizable toner for one-component developing system at 14° C., 40%RH, and 30° C., 90%RH. Satisfactory visible image was obtained under both conditions.

The paper carrying the visible image was treated under a pressing roller at a pressure of 350 kg./cm$^2$. There was obtained a toner image with high sharpness and well fixed onto the paper. Further, off-setting of the toner was at a very low level.

COMPARISON EXAMPLE 1

A dispersion of 3 g. of carbon black and 15 g. of magnetite (tradename EPT-1000, available Toda Industry Co., Ltd., Japan) in 27 g. of diisopropylnaphthalene prepared in a mortar was mixed with 10 g. of a mixture of acetone and methylene chloride (1:3) to prepare a primary liquid. Separately, 4 g. of an adduct of hexamethylene diisocyanate and hexanetriol (3:1 molar ratio addition product) was added to the primary liquid to prepare a secondary liquid. The mixing procedure was carried out at a temperature of not higher than 25° C.

To an aqueous solution of 6 g. of carboxymethylcellulose (Celogen 5A, trade name of Daiichi Chemical Industry Co., Ltd.) in 60 ml. of water kept at 20° C. was portionwise added under vigorous stirring the secondary liquid to produce an oil-in-water emulsion containing oily droplets having diameter of 5–15 μm. The formation of the emulsion was carried out at a temperature of not higher than 20° C. by chilling the outer surface of the reaction vessel. The stirring was further continued after the production of emulsion. To the emulsion was added 100 ml. of aqueous diethylenetriamine solution (5 wt.% concentration, kept at 20° C.). The resulting mixture was then slowly heated up to 90° C. over 30 min. and kept for 20 min. at the temperature to perform the encapsulating reaction.

Thus obtained aqueous microcapsule dispersion was subjected to centrifugal separation (5000 rpm) to separate the microcapsules from water. The separated microcapsules were then dispersed in water to prepare 30 wt.% dispersion. This dispersion was again subjected to centrifugal separation and the separated microcapsules were again dispersed in water in the same manner as above. The microcapsule slurry thus washed with water was heated in oven to obtain a powdery encapsulated toner.

The powder characteristics and volume resistance of the above encapsulated toner were evaluated under two temperature-humidity conditions, namely, (I) 14° C., 40%RH, and (II) 30° C., 90%RH.

Under the condition (I), the encapsulated toner particles slightly aggromerated, but flowable. The volume resistance was $10^{12}$ ohm-cm.

Under the condition (II), the encapsulated toner particles extremely aggromerated to reduce the flowability prominently. The volume resistance was $10^{9}$ ohm-cm.

According to the conventional electrostatographic copying and duplicating process, a latent image was developed through magnetic brush system using the above encapsulated toner as the magnetizable toner for one-component developing system at 14° C., 40%RH. Satisfactory visible image was obtained. However, the process carried out under the condition of 30° C., 90%RH showed somewhat poor toner image density, and further the non-image portion was somewhat stained.

COMPARISON EXAMPLE 2

A dispersion of 3 g. of carbon black and 15 g. of magnetite (tradename EPT-1000, available Toda Industry Co., Ltd., Japan) in 27 g. of diisopropylnaphthalene prepared in a mortar was mixed with 10 g. of a mixture of acetone and methylene chloride (1:3) to prepare a primary liquid. Separately, 4 g. of an adduct of hexamethylene diisocyanate and hexanetriol (3:1 molar ratio addition product) was added to the primary liquid to prepare a secondary liquid. The mixing procedure was carried out at a temperature of not higher than 25° C.

To an aqueous solution of 10 g. of polyvinyl alcohol (average polymerization degree 500, saponification degree 98%) in 60 ml. of water kept at 20° C. was portionwise added under vigorous stirring the secondary liquid to produce an oil-in-water emulsion containing oily droplets having diameter of 5–15 μm. The formation of the emulsion was carried out at a temperature of not higher than 20° C. by chilling the outer surface of the reaction vessel. The stirring was further continued after the production of emulsion. To the emulsion was added 100 ml. of water (kept at 40° C.). The resulting mixture was then slowly heated up to 90° C. over 30 min. and kept for 20 min. at the temperature to perform the encapsulating reaction.

Thus obtained aqueous microcapsule dispersion was subjected to centrifugal separation (5000 rpm) to separate the microcapsules from water. The separated microcapsules were then dispersed in water to prepare 30 wt.% dispersion. This dispersion was again subjected to centrifugal separation and the separated microcapsules were again dispersed in water in the same manner as above. The microcapsule slurry thus washed with water was heated in oven to obtain a powdery encapsulated toner.

The powder characteristics and volume resistance of the above encapsulated toner were evaluated under two temperature-humidity conditions, namely, (I) 14° C., 40%RH, and (II) 30° C., 90%RH.

Under the condition (I), the encapsulated toner particles slightly aggromerated, but flowable. The volume resistance was $10^{10}$ ohm-cm.

Under the condition (II), the encapsulated toner particles extremely aggromerated to reduce the flowability prominently. The volume resistance was $10^{8}$ ohm-cm.

According to the conventional electrostatographic copying and duplicating process, a latent image was developed through magnetic brush system using the above encapsulated toner as the magnetizable toner for one-component developing system at 14° C., 40%RH, and 30° C., 90%RH. The toner image density was somewhat poor, and further the non-image portion was somewhat stained.

COMPARISON EXAMPLE 3

A microcapsule dispersion was prepared in the same manner as in Comparison Example 2.

To the microcapsule dispersion was added 0.5 g. of methylolmelamine (Sumitex Resin M-3, available from Sumitomo Chemical Co., Ltd.). The resulting mixture was adjusted to pH 4.5 by addition of acetic acid, and heated under stirring at 60° C.

Thus obtained aqueous microcapsule dispersion was subjected to centrifugal separation (5000 rpm) to separate the microcapsules from water. The separated microcapsules were then dispersed in water to prepare 30 wt.% dispersion. This disrpesion was again subjected to centrifugal separation and the separated microcapsules were again dispersed in water in the same manner as above. The washing procedure was repeated once more time. The microcapsule slurry thus washed with water was dried in an oven to obtain a powdery encapsulated toner.

The powder characteristics and volume resistance of the above encapsulated toner were evaluated under two temperature-humidity conditions, namely, (I) 14° C., 40%RH, and (II) 30° C., 90%RH.

Under the condition (I), the encapsulated toner particles slightly aggromerated, but flowable. The volume resistance was $10^{11}$ ohm-cm.

Under the condition (II), the encapsulated toner particles extremely aggromerated to reduce the flowability prominently. The volume resistance was $10^{9}$ ohm-cm.

According to the conventional electrostatographic copying and duplicating process, a latent image was developed through magnetic brush system using the above encapsulated toner as the magnetizable toner for one-component developing system at 14° C., 40%RH. Satisfactory visible image was obtained. However, the process carried out under the condition of 30° C., 90%RH showed somewhat poor toner image density, and further the non-image portion was somewhat stained.

I claim:

1. A process for the preparation of an encapsulated electrostatographic toner material comprising a stage of forming shells around micro-droplets of hydrophobic core material containing colorant dispersed in an aqueous medium to produce microcapsules therein, and a stage of separating the microcapsules from the aqueous medium, which is characterized in that methylcellulose is employed for stabilizing the micro-droplets of core material in the aqueous medium.

2. The process for the preparation of an encapsulated electrostatographic toner material as claimed in claim 1, in which said methylcellulose has an average molecular weight ranging from 10,000 to 50,000.

3. The process for the preparation of an encapsulated electrostatographic toner material as claimed in claim 1, in which the methylcellulose has a methoxy substitution degree in the range of 1.2 to 2.0.

4. The process for the preparation of an encapsulated electrostatographic toner material as claimed in claim 3 in which the methylcellulose is substituted with hydrooxypropoxy groups in a portion of its methoxy groups.

5. The process for the preparation of an encapsulated electrostatographic toner material as claimed in claim 4, in which 20 to 60% of the methoxy groups attached to the methylcellulose are substituted with hydroxypropoxy groups.

6. The process for the preparation of an encapsulated electrostatographic toner material as claimed in claim 1 in which said the stage of forming shells around micro-droplets of core material is performed by an interfacial polymerization method.

7. The process for the preparation of an encapsulated electrostatographic toner material as claimed in claim 1, in which said methylcellulose is made hydrophobic by treatment with methylolmelamine.

8. The process for the preparation of an encapsulated electrostatographic toner material as claimed in claim 1, in which said methylcellulose is employed in an amount of not higher than 10% by weight based on the total amount of materials constituting the microcapsules.

9. The process for the preparation of an encapsulated electrostatographic toner material as claimed in claim 6 in which said shell comprises at least one resin selected from the group consisting of a polyurethane resin, a polyurea resin and a polyamide resin.

10. The process for the preparation of an encapsulated electrostatographic toner material as claimed in claim 6 in which said shell is composed of a complex layer comprising at least two resins selected from the group consisting of a polyurethane resin, a polyurea resin and a polyamide resin.

* * * * *